US010905192B1

(12) United States Patent
Cheney

(10) Patent No.: US 10,905,192 B1
(45) Date of Patent: Feb. 2, 2021

(54) RAPID-ENTRY FOOTWEAR HAVING A POCKET FOR A COMPRESSED MEDIUM

(71) Applicant: FAST IP, LLC, Vineyard, UT (US)

(72) Inventor: Craig Cheney, Orem, UT (US)

(73) Assignee: FAST IP, LLC, Vineyard, UT (US)

( * ) Notice: Subject to any disclaimer, the term of this patent is extended or adjusted under 35 U.S.C. 154(b) by 0 days.

(21) Appl. No.: 16/996,503

(22) Filed: Aug. 18, 2020

Related U.S. Application Data

(60) Provisional application No. 62/895,330, filed on Sep. 3, 2019, provisional application No. 62/966,499, filed on Jan. 27, 2020.

(51) Int. Cl.
*A43B 11/00* (2006.01)
*A43B 3/24* (2006.01)
*A43B 23/08* (2006.01)

(52) U.S. Cl.
CPC ..... *A43B 3/246* (2013.01); *A43B 3/248* (2013.01); *A43B 11/00* (2013.01); *A43B 23/08* (2013.01)

(58) Field of Classification Search
CPC ..... A43B 3/24; A43B 3/248; A43B 11/00; A43B 23/08
USPC ..... 36/69, 105
See application file for complete search history.

(56) References Cited

U.S. PATENT DOCUMENTS

| | | | |
|---|---|---|---|
| 112,439 | A | 3/1871 | Francis |
| 808,948 | A | 1/1906 | Roberts et al. |
| 827,330 | A | 7/1906 | Tillson |
| 863,549 | A | 8/1907 | Metz |
| 881,153 | A | 3/1908 | Rickert |
| 923,860 | A | 6/1909 | Kroell |
| 921,461 | A | 9/1909 | Rickert |
| 1,081,678 | A | 12/1913 | Langerak |
| 1,116,462 | A | 11/1914 | Moran |
| 1,464,342 | A | 8/1923 | Rothacher |
| 1,494,236 | A | 5/1924 | Greathouse |
| 1,686,175 | A | 10/1928 | Read |
| 1,926,818 | A | 9/1933 | Ratcliff |
| 2,069,752 | A | 8/1935 | Dorr |
| 2,266,732 | A | 4/1940 | Babinchak |
| 2,368,514 | A | 1/1945 | Baehr |
| 2,450,250 | A | 3/1945 | Napton |
| 2,452,502 | A | 4/1945 | Tarbox |
| 2,736,110 | A | 2/1956 | Hardimon |
| 2,763,071 | A | 9/1956 | Kingsley |
| 2,829,448 | A | 4/1958 | Minera |
| 2,920,402 | A | 1/1960 | Minera |
| 3,000,116 | A | 9/1961 | Ally |
| 3,146,535 | A | 9/1964 | Owings |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

Sneider, "Kizik Handsfree New York Shoe Review," https://the-gadgeteer.com/2018/06/27/kizik-handsfree-new-york-show-review/ (2018).

*Primary Examiner* — Marie D Bays

(57) ABSTRACT

A rapid-entry shoe having an upper, a sole portion, and at least one pocket coupled to a rear portion of the upper and encapsulating a compressed medium that biases a topline of the shoe toward an uncollapsed configuration.

13 Claims, 9 Drawing Sheets

(56) References Cited

U.S. PATENT DOCUMENTS

| | | | | |
|---|---|---|---|---|
| 4,489,509 | A | 12/1984 | Libit | |
| 4,590,690 | A | 5/1986 | Pfander | |
| 4,811,502 | A | 3/1989 | Barret | |
| 4,924,605 | A | 5/1990 | Spademan | |
| 4,972,613 | A | 11/1990 | Loveder | |
| 5,054,216 | A | 10/1991 | Lin | |
| 5,127,170 | A | 7/1992 | Messina | |
| 5,181,331 | A | 1/1993 | Berger | |
| 5,184,410 | A | 2/1993 | Hamilton | |
| 5,282,327 | A | 2/1994 | Ogle | |
| 5,341,583 | A | 8/1994 | Hallenbeck | |
| 5,371,957 | A | 12/1994 | Gaudio | |
| 5,467,537 | A | 11/1995 | Aveni et al. | |
| 5,481,814 | A | 1/1996 | Spencer | |
| 5,842,292 | A | 12/1998 | Siesel | |
| 5,997,027 | A | 12/1999 | Jungkind | |
| 6,000,148 | A * | 12/1999 | Cretinon | A43B 5/00 36/69 |
| 6,125,555 | A | 10/2000 | Schenkel | |
| 6,189,239 | B1 | 2/2001 | Gasparovic et al. | |
| 6,360,454 | B1 | 3/2002 | Dachgruber | |
| 6,378,230 | B1 | 4/2002 | Rotem et al. | |
| 6,671,980 | B1 | 1/2004 | Liu | |
| 6,684,533 | B1 | 2/2004 | Su | |
| 6,922,917 | B2 | 8/2005 | Kerns | |
| 6,925,732 | B1 | 8/2005 | Clarke | |
| 6,938,361 | B2 | 9/2005 | Su | |
| 7,103,994 | B2 | 9/2006 | Johnson | |
| 7,178,270 | B2 | 2/2007 | Hurd et al. | |
| 7,225,563 | B2 | 6/2007 | Chen | |
| 7,439,837 | B2 | 10/2008 | McDonald | |
| 7,661,205 | B2 | 2/2010 | Johnson | |
| 7,685,747 | B1 | 3/2010 | Gasparovic et al. | |
| 7,793,438 | B1 | 9/2010 | Busse et al. | |
| 7,823,299 | B1 | 11/2010 | Brigham | |
| 7,975,403 | B2 | 7/2011 | Mosher | |
| D648,512 | S | 11/2011 | Schlageter | |
| 8,065,819 | B2 | 11/2011 | Kaufman | |
| 8,087,188 | B2 | 1/2012 | Labbe | |
| 8,161,669 | B2 | 4/2012 | Keating | |
| 8,225,535 | B2 | 7/2012 | Dillenbeck | |
| 8,499,474 | B2 | 8/2013 | Kaufman | |
| 8,769,845 | B2 | 7/2014 | Lin | |
| 62,186,148 | | 6/2015 | Zahabian | |
| 9,615,624 | B2 | 4/2017 | Kilgore et al. | |
| 9,675,132 | B2 | 6/2017 | Marshall | |
| 9,820,527 | B2 | 11/2017 | Pratt et al. | |
| 9,877,542 | B2 | 1/2018 | Pratt | |
| 10,306,947 | B2 | 6/2019 | Pratt et al. | |
| D854,303 | S * | 7/2019 | Flanagan | A43B 11/00 D2/972 |
| 10,455,898 | B1 | 10/2019 | Orand et al. | |
| 10,617,174 | B1 * | 4/2020 | Hopkins | A43B 13/148 |
| 10,638,810 | B1 * | 5/2020 | Cheney | A43B 3/248 |
| 2002/0144434 | A1 | 10/2002 | Farys | |
| 2005/0022428 | A1 | 2/2005 | Anderson | |
| 2005/0039348 | A1 * | 2/2005 | Raluy | A43B 11/00 36/50.1 |
| 2005/0076540 | A1 | 4/2005 | Su | |
| 2005/0198867 | A1 | 9/2005 | Labbe | |
| 2007/0074425 | A1 | 4/2007 | Leong | |
| 2008/0086911 | A1 | 4/2008 | Labbe | |
| 2008/0189984 | A1 | 8/2008 | Januszewski et al. | |
| 2008/0307673 | A1 | 12/2008 | Johnson | |
| 2008/0313929 | A1 * | 12/2008 | Hoyt | A43B 1/10 36/105 |
| 2011/0016751 | A1 | 1/2011 | Somerville | |
| 2011/0146106 | A1 | 6/2011 | Kaufman | |
| 2012/0216429 | A1 | 8/2012 | Bastida et al. | |
| 2012/0317839 | A1 | 12/2012 | Pratt | |
| 2013/0185959 | A1 | 7/2013 | Coleman | |
| 2013/0219747 | A1 | 8/2013 | Lederer | |
| 2015/0305432 | A1 | 10/2015 | Wiens | |
| 2016/0374427 | A1 * | 12/2016 | Zahabian | A43B 3/24 36/102 |
| 2017/0055630 | A1 * | 3/2017 | Marshall | A43B 3/24 |
| 2017/0360143 | A1 | 12/2017 | Pratt | |
| 2017/0360151 | A1 | 12/2017 | Pratt | |
| 2018/0110287 | A1 | 4/2018 | Hopkins et al. | |
| 2018/0110292 | A1 * | 4/2018 | Beers | A43B 13/181 |
| 2018/0289109 | A1 * | 10/2018 | Beers | A43B 3/248 |
| 2018/0295942 | A1 | 10/2018 | Drake | |
| 2020/0205511 | A1 * | 7/2020 | Hopkins | A43B 23/028 |
| 2020/0205516 | A1 * | 7/2020 | Kilgore | A43B 21/24 |
| 2020/0205518 | A1 * | 7/2020 | Hopkins | A43B 11/00 |
| 2020/0205520 | A1 * | 7/2020 | Kilgore | A43B 23/0245 |
| 2020/0253333 | A1 * | 8/2020 | Kilgore | A43B 23/088 |

FOREIGN PATENT DOCUMENTS

| | | |
|---|---|---|
| CN | 201005111 | 1/2008 |
| DE | 19534249 | 3/1997 |
| DE | 19611797 | 10/1997 |
| DE | 29809404 | 8/1998 |
| DE | 10247163 | 10/2002 |
| DE | 102004005288 | 8/2005 |
| EP | 1059044 | 12/2000 |
| GB | 2517399 | 8/2013 |
| JP | 181910 | 6/1989 |
| JP | 2001149394 | 6/2001 |
| JP | 2006055571 | 3/2006 |
| WO | 2007080205 | 7/2007 |
| WO | 2009089572 | 7/2009 |
| WO | 2009154350 | 12/2009 |
| WO | 2017004135 | 1/2017 |

* cited by examiner

RAPID-ENTRY FOOTWEAR HAVING A POCKET FOR A COMPRESSED MEDIUM

CROSS-REFERENCE TO RELATED APPLICATIONS

This application claims the benefit of U.S. Provisional Patent Application No. 62/895,330, filed Sep. 3, 2019 entitled "Rapid-Entry Footwear Having a Pocket for a Compressed Medium," and U.S. Provisional Patent Application No. 62/966,499, filed Jan. 27, 2020 entitled "Rapid-Entry Footwear Having a Pocket for a Compressed Medium," both of which are incorporated herein by reference in their entireties for all purposes.

FIELD

The present disclosure relates to footwear, and more particularly to rapid-entry footwear having a pocket for a compressed medium.

BACKGROUND

Whether due to inconvenience or inability, donning and doffing of shoes, including tying or otherwise securing the same, may be undesirable and/or present difficulties to some individuals. The present disclosure addresses this need.

SUMMARY

The present disclosure relates to footwear, and more particularly to rapid-entry footwear having a pocket for a compressed medium. In accordance with an example embodiment, a rapid-entry shoe of the present disclosure comprises a sole portion, an upper coupled to the sole portion, and a pocket coupled to the upper. In various embodiments, the pocket comprises an arm and a leg, the leg of the pocket being substantially parallel to the sole portion, and the arm of the pocket being at an angle to the leg. In various embodiments, the pocket encapsulates a medium and the medium is pressurized. In various embodiments, the leg comprises a flange coupled to the sole portion. In various embodiments, the rapid-entry shoe has a collapsed configuration in which an opening of the rapid-entry shoe is expanded to facilitate reception of a foot of an individual donning the rapid-entry shoe, and an arm of the pocket is compressed downward toward the sole portion of the rapid-entry shoe. In various embodiments, the rapid-entry shoe has an uncollapsed configuration in which the opening is unexpanded to retain a foot within the rapid-entry shoe, and an arm of the pocket is expanded away from the sole portion of the rapid-entry shoe. In this regard, the rapid-entry shoe is biased by the pressurized medium toward the uncollapsed configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
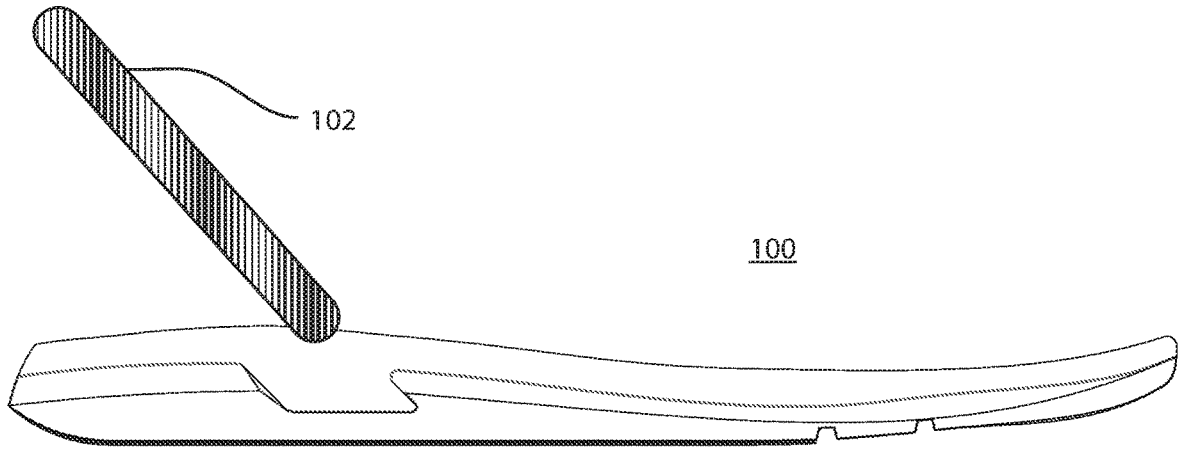
FIGS. 1A and 1B illustrate an example embodiment of a rapid-entry shoe having a pocket.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

In general, disclosed herein is a rapid-entry shoe having an upper, a sole portion, and at least one pocket encapsulating a compressed medium. In accordance with various embodiments, the at least one pocket is coupled to a rear portion of the upper. In accordance with various embodiments, a topline of the rear portion has an uncollapsed configuration. In accordance with various embodiments, the topline of the rear portion has a collapsed configuration in which a dimension of an opening of the shoe is greater than in the uncollapsed configuration. In accordance with various embodiments, the at least one pocket biases the topline toward the uncollapsed configuration.

Figure 1B:
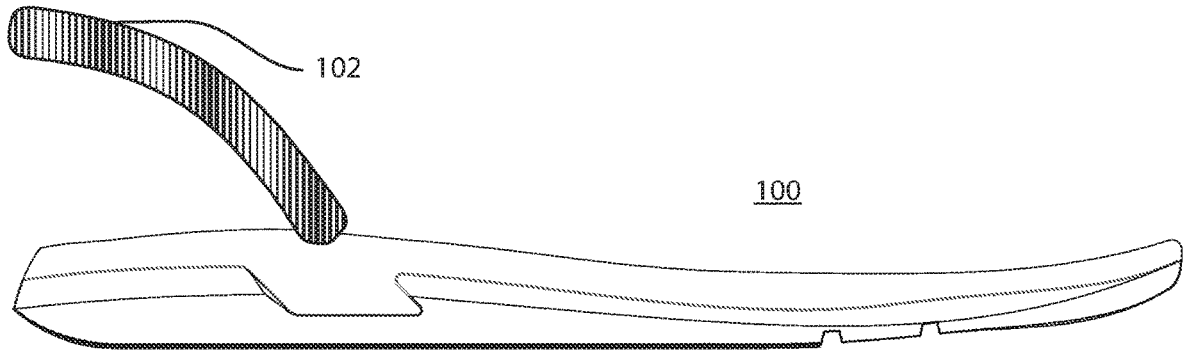

Turning to specific embodiments, and with reference to FIGS. 1A and 1B, example embodiments of the present disclosure comprise one or more pockets 102 integrated into a rapid-entry shoe 100. In example embodiments, the one or more pockets 102 are configured to create or otherwise enhance rebound of a rear portion of an upper of a rapid-entry shoe 100, for example, at a topline of a rapid-entry shoe 100.

As used herein, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, a "rear portion of an upper" refers to any rear portion of an upper, for example, a heel portion or backstrap, including a topline thereof.

In general, a pocket 102 is an enclosed vessel, chamber, bladder, bag, or the like, capable of maintaining a specified volume of a medium without loss of the same (or substantial loss of the same) for an extended period of time (e.g., weeks, months, or years). In this regard, a medium can be encapsulated within a pocket 102.

In some embodiments, a pocket 102 comprises a plurality of smaller enclosed vessels, chambers, bladders, bags, or the like (e.g., coupled and/or otherwise arranged in a quilted pattern).

In some embodiments, a pocket 102 can be made from a deformable material, e.g., thermoplastic polyurethane (TPU), ethylene-vinyl acetate (EVA), poly ethylene-vinyl acetate (PEVA), polyvinyl chloride, urethane or another polymer material. In various embodiments, a pocket 102 can be made from a deformable material that is also resilient. In various embodiments, a pocket 102 can be made from a material having a shore hardness of from about 80 A to about 95 A, or about 85 A. Without limiting the foregoing, a pocket 102 can be made from TPU 95 A or TPU 85 A. A pocket 102 can be transparent, semi-transparent, opaque, or semi-opaque, and comprise one or more ornamental colors or patterns.

A pocket 102 can comprise a material, or comprise one or more features, to prevent kinking of a pocket 102 when a rapid-entry shoe 100 is transitioning between collapsed and uncollapsed configurations (as discussed infra). For example, a pocket 102 can have one or more folds or pleats at or near a portion of a pocket 102 to be flexed, arched, deflected, bent, or otherwise deformed (e.g., a curve or an angle at an inner edge of a vertex) to thereby control or otherwise direct the same. Similarly, a pocket 102 can have one or more cutouts, recesses, weakened portions (e.g., different thickness and/or density), or the like, e.g., in a circular shape, at or near a portion of a pocket 102 to be flexed, arched, deflected, bent, or otherwise deformed (e.g., a curve or an angle at an inner edge of a vertex) to thereby control or otherwise direct the same.

Dimensions of a pocket 102 can vary according to either or both of the objectives of a rapid-entry shoe 100 and the placement of a pocket 102 within a rapid-entry shoe 100. For example, a pocket 102 can have an elongated tubular shape or any other elliptical, non-elliptical, or random shape, as illustrated in FIGS. 2A-2L.

As used herein, an "elliptical" shape refers to any shape that generally lacks a point where two lines, curves, or surfaces converge to form an angle. For example, an "elliptical" shape encompasses traditional Euclidian geometric shapes such as circles and ellipses, as well as other non-angular shapes (that lack any angles), even if those shapes do not have designations common in Euclidian geometry.

As used herein, a "non-elliptical" shape refers to any shape that includes at least one point where two lines, curves, or surfaces converge to form an angle. For example, a "non-elliptical" shape encompasses traditional Euclidian geometric shapes such as triangles, rectangles, squares, hexagons, trapezoids, pentagons, stars, and the like as well as other shapes that have at least one angle even if those shapes do not have designations common in Euclidian geometry.

Figure 2A:
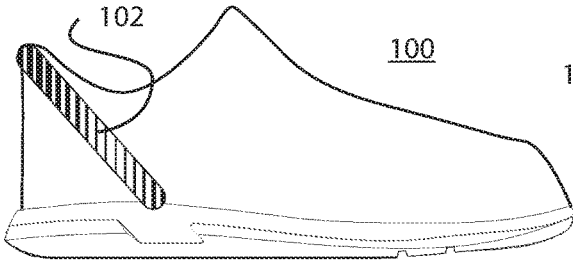
FIGS. 2A-2L illustrate example embodiments of rapid-entry shoes, each having a pocket having a different shape.
Figure 2B:
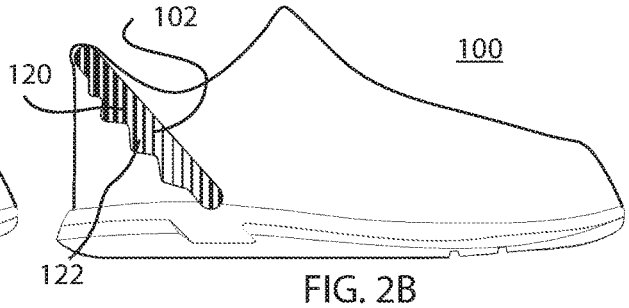
Figure 2C:
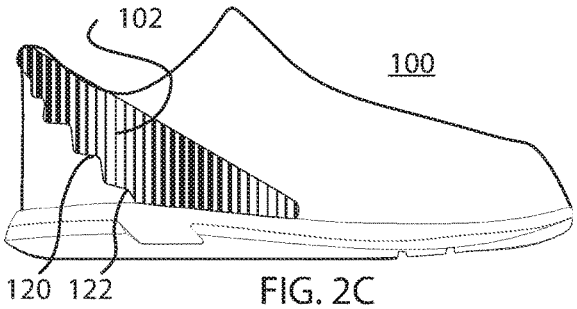
Figure 2D:
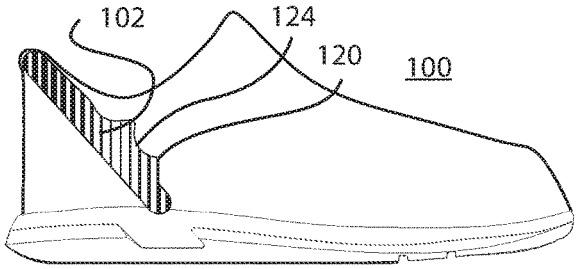
Figure 2E:
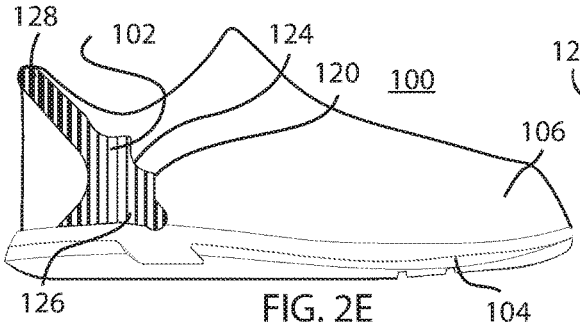
Figure 2F:
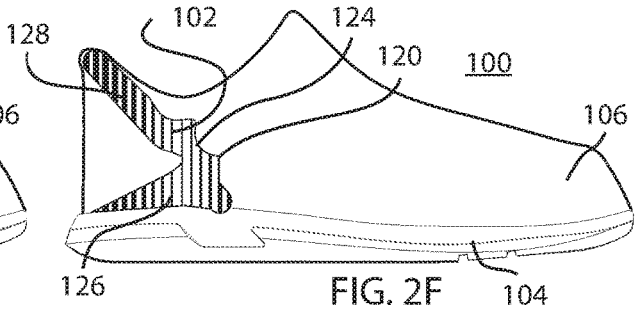
Figure 2G:
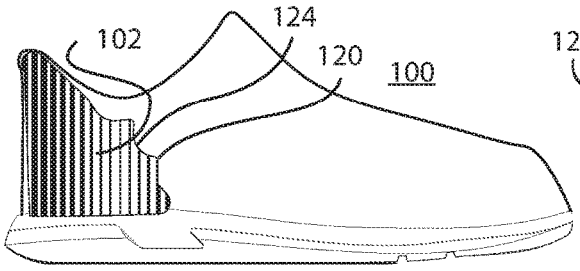
Figure 2H:
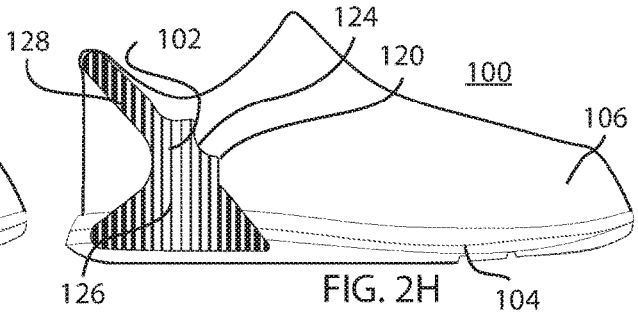
Figure 2I:
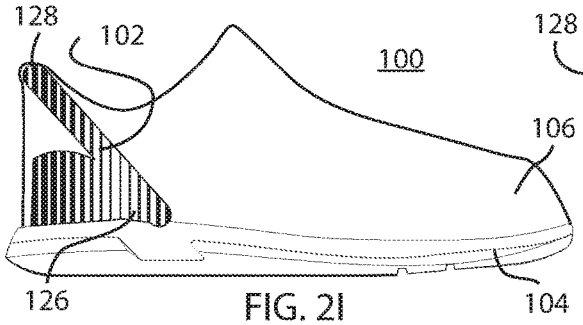
Figure 2J:
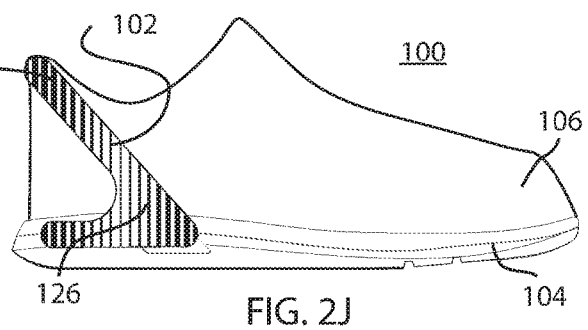
Figure 2K:
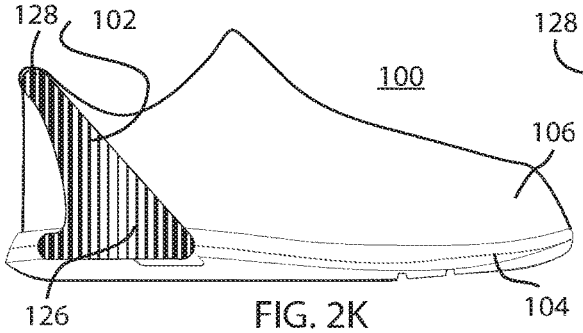
Figure 2L:
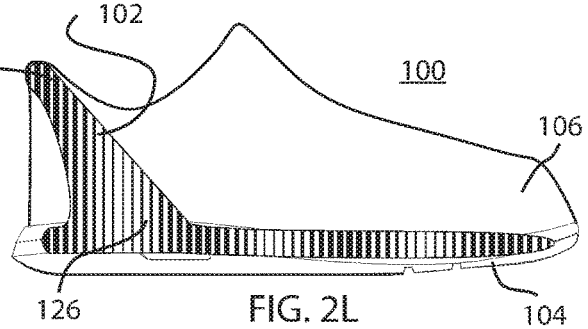
Figure 3A:
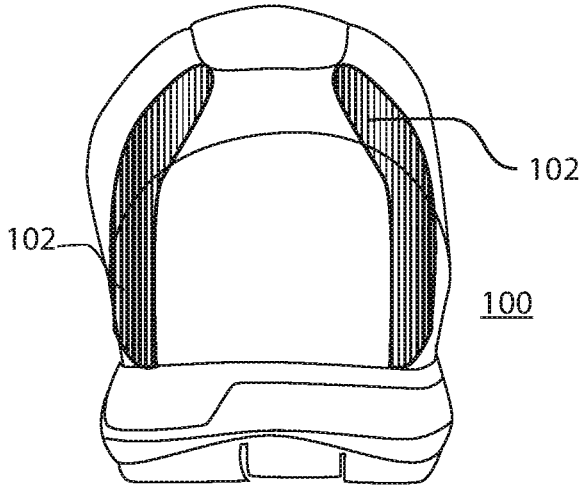
FIGS. 3A-3C illustrate example embodiments of rapid-entry shoes having pockets, pockets with a stabilizer, and a pocket, respectively, on lateral and medial sides.
Figure 3B:
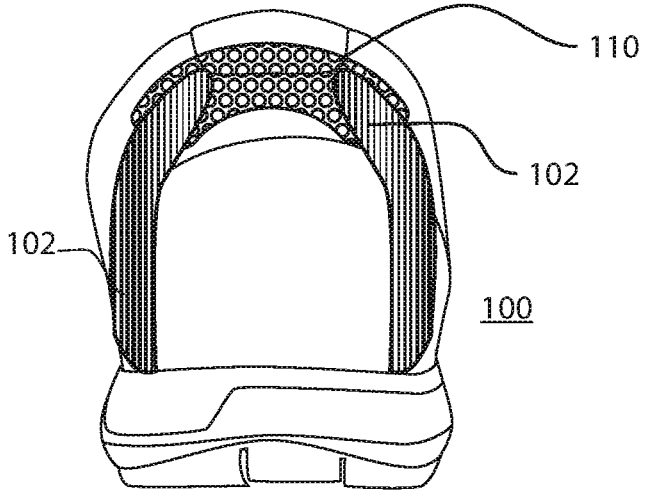
Figure 3C:
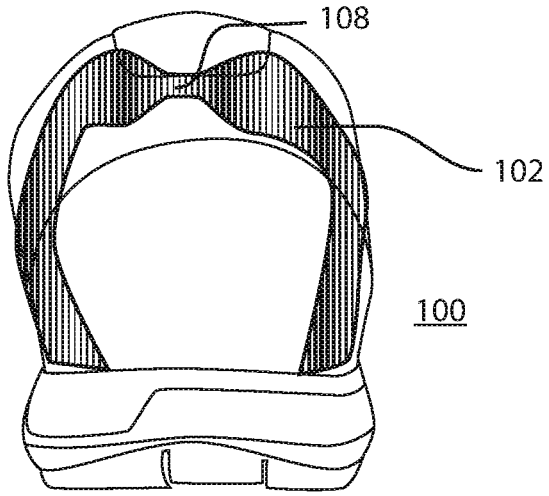

In each of the embodiments illustrated in FIGS. 2A-2L, and as discussed infra with reference to FIGS. 3A-3C, pocket 102 can be located on a lateral side of a rapid-entry shoe 100, a medial side of a rapid-entry shoe 100, or both lateral and medial sides of a rapid-entry shoe 100 (e.g., lateral and medial sides not coupled, lateral and medial sides coupled with a stabilizer or stiffener, or lateral and medial sides comprised of the same pocket extending continuously between lateral and medial sides).

Additionally, while in each of the embodiments illustrated in FIGS. 2A-2L pocket 102 is shown on an outside of sole portion 104, pocket 102 can be coupled to an inside of sole portion 104 (e.g., within an outsole, between an outsole and a midsole, adjacent an insole, etc.), as discussed infra with reference to FIGS. 5A-5F.

In example embodiments, pocket 102 can comprise a plurality of serrations or scallops 120 along a lower edge 122 (see, e.g., FIGS. 2B and 2C) or an upper edge 124 (see, e.g., FIGS. 2D-2H), and/or an vertex of pocket 102. The plurality of serrations or scallops 120 may be configured to control the rate and/or direction the pocket 102 is flexed, arched, deflected, bent, or otherwise deformed.

In example embodiments, pocket 102 comprises a pocket leg 126 and a pocket arm 128 forming a u shape or a v shape (e.g., the leg of the pocket being coupled, or substantially parallel, to the sole portion, and the arm of the pocket being at an angle to the leg and coupled to a rear portion of the upper).

In such embodiments, u-shaped pocket 102 can comprise a curve (see, e.g., FIGS. 2E, 2H and 2J-2L) or v-shaped pocket 102 can comprise an angle (see, e.g., FIGS. 2F and 2I) on the inside of the vertex between pocket leg 126 (e.g., coupled to and/or extending at least partially to sole portion 104) and pocket arm 128 (e.g., coupled to and/or extending at least partially to upper portion 106).

In example embodiments, and with reference to FIG. 2G, pocket 102 can extend completely around a rear portion of the upper of rapid-entry shoe 100 (i.e., not being an arch and forming a window, as discussed infra).

In example embodiments, pocket leg 126 extends both rearward (all or partially to a rearward most point of rapid-entry shoe 100) and forward (all or partially to a forward most point of rapid-entry shoe 100) relative to pocket arm 128 (see, e.g., FIG. 2L). In such embodiments, pocket leg 126 can further extend under, and/or comprise, all or a portion of a footbed, insole, sock liner or the like of rapid-entry shoe 100, as discussed infra.

In example embodiments, a pocket 102 (or a portion thereof, e.g., a flange, as discussed infra) comprises variable wall thicknesses and/or densities to control the rate and/or direction the pocket 102 is flexed, arched, deflected, bent, or otherwise deformed. For example, an inner wall of a pocket 102 (i.e., a wall closer to an interior of a shoe) can have a thickness different from that of an outer wall of a pocket 102 (i.e., a wall further from an interior of a shoe). As another example, a leg of a pocket 102 can have a density different from that of an arm of a pocket 102. Such embodiments, for example, may control or otherwise direct outward flex of the pocket 102 (e.g., to expand a dimension of an opening of the shoe) when it is flexed, arched, deflected, bent, or otherwise deformed.

With reference back to FIGS. 1A and 1B, a pocket 102 can be filled with a medium that is compressible. In this regard, a pocket 102 can be filled with a medium comprising either a gas (e.g., air, nitrogen, oxygen) or a liquid (e.g., a gel). In some embodiments, filling a pocket 102 with a medium comprised of molecules having a larger atomic radius (e.g., a nitrogen molecule has a larger atomic radius than an oxygen molecule) can minimize leakage of the medium from a pocket 102.

In various embodiments, a medium or a pocket 102 is colored. That is, a pocket 102 can be clear and a medium can be colored (e.g., red, blue, green) to facilitate visualization of a medium (and movement thereof) within a pocket, or a medium can be clear and a pocket 102 can be colored. In still other embodiments, a pocket 102 can be colored and a medium can be colored in order to create a new combination color or effect.

In accordance with the present disclosure, a pocket 102 is pressurized with a compressed medium. In this regard, a pocket 102 can be filled with a medium by injection and heat sealing. In other embodiments, a pocket 102 can be filled with a medium via a valve, for example, a one-way valve. In various embodiments, a valve can be accessed by a user to controllably fill and/or empty a medium, in whole or in part.

In some embodiments, the pressure of a gas in a pocket 102 can be greater than atmospheric pressure at sea level, while in other embodiments, the pressure of a gas in a pocket 102 can be less than or substantially the same as atmospheric pressure at sea level. Without limiting the foregoing, in example embodiments, a pocket 102 can be pressurized to from about 5 to about 50 psi, or from about 20 to about 35 psi.

With reference now to FIG. 3A, a pocket 102 can be located on a lateral side of a rapid-entry shoe 100, a medial side of a rapid-entry shoe 100, or both lateral and medial sides of a rapid-entry shoe 100. In such embodiments, a pocket 102 can be angled downward from a rear portion toward a forward portion of a shoe, for example, at an angle of about 30 to about 60 degrees measured from a sole portion (as defined infra), or about 45 degrees measured from a sole portion.

Turning to FIG. 3B, a pocket 102 can be located on a lateral side of a rapid-entry shoe 100, a medial side of a rapid-entry shoe 100, or both lateral and medial sides of a rapid-entry shoe 100. In such embodiments, a pocket 102 on a lateral side can be coupled with a stabilizer or stiffener 110 (e.g., structure separate from the upper) to a pocket 102 on a medial side.

With reference to FIG. 3C, a pocket 102 can extend all or partially around a rapid-entry shoe 100 (i.e., from a medial side to a lateral side of a rapid-entry shoe 100). In some embodiments, pocket 102 can be an arch and form a window at a rear portion of the upper of rapid-entry shoe 100. In some embodiments, pocket 102 can comprise a narrowed section 108 at the back of a rapid-entry shoe 100, for example, to accommodate an Achilles tendon of a foot.

In embodiments comprising a plurality of pockets, the pockets need not be identically shaped, or identically pressurized. For example, a medial pocket can be shaped differently (e.g., size or dimensions) from a lateral pocket, and a lateral pocket can be pressurized differently (i.e., more or less) from a medial pocket.

Figure 4A:
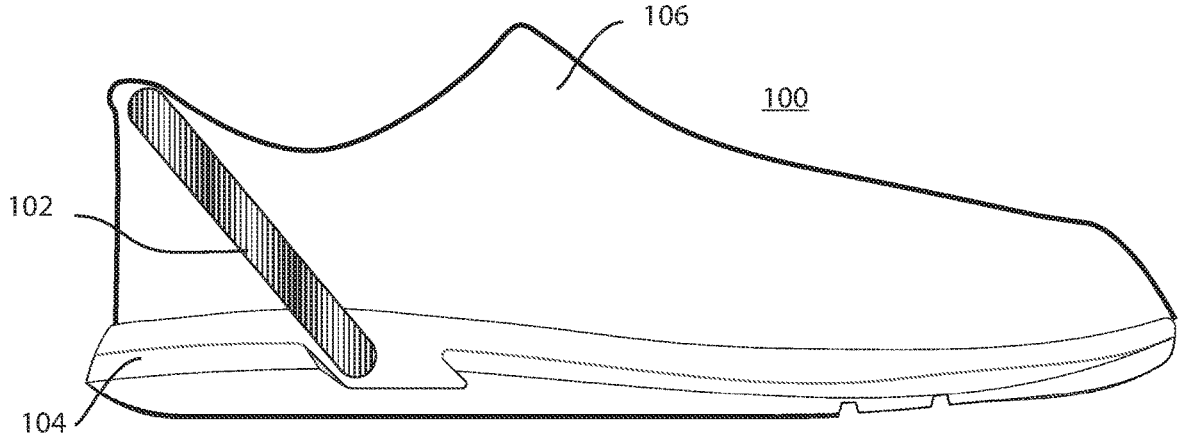
FIGS. 4A and 4B illustrate example embodiments of pockets coupled to rapid-entry shoes.

Turning now to FIG. 4A, in some embodiments, a lower edge of pocket 102 is coupled to a sole portion 104 of a rapid-entry shoe 100. As used herein, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe, for example, an insole or an internal cushion. In such embodiments, the sole portion 104 may comprise a cutout or recess within which to receive the pocket 102 (or a portion thereof).

In some embodiments, and with momentary reference to FIG. 2L, a pocket 102 is coupled to an internal cushion of a rapid-entry shoe 100 under a foot to provide impact support to a foot.

Figure 4B:
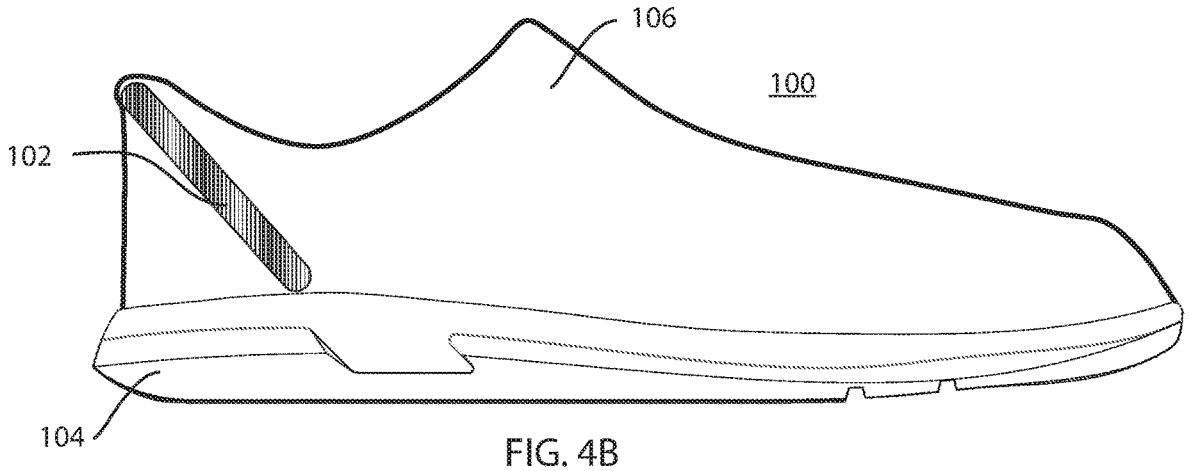

Turning now to FIG. 4B, in some embodiments, a lower edge of pocket 102 is coupled to an upper portion 106 of a rapid-entry shoe 100.

In connection with any of the foregoing embodiments, a pocket 102 can also be coupled to a rear portion of an upper of a rapid-entry shoe 100. That is, in addition to being coupled to a rear portion of an upper of a rapid-entry shoe 100, a lower edge of pocket 102 can be coupled (e.g., at another end or side) to a sole portion or an upper portion.

With reference now to FIGS. 5A-5F, a pocket 102 can comprise a flange 103 surrounding all or a portion of it, e.g., an arm and/or a leg of a pocket 102. The flange 103 can be used to couple (e.g., adhere, stitch) the pocket 102 to a sole portion and/or an upper portion of a rapid-entry shoe. A flange 103 can extend from an inner wall of a pocket 102 (i.e., a wall closer to an interior of a shoe), from an outer wall of a pocket 102 (i.e., a wall further from an interior of a shoe), or from between an inner wall and an outer wall. The flange 103 extending from an outer wall, or extending from between an inner wall and an outer wall, can contribute to the creation of a cup or recess for securely receiving a foot within a rear portion of an upper of a rapid-entry shoe.

Figure 5A:
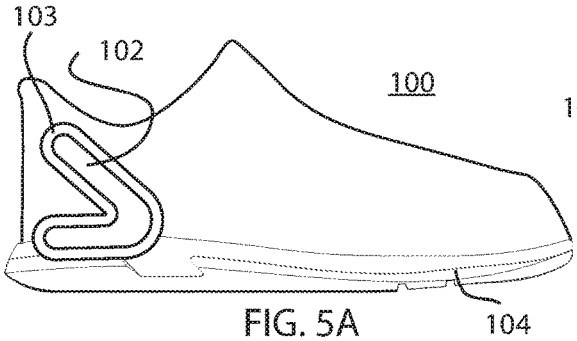
FIGS. 5A-5F illustrate example embodiments of rapid-entry shoes, each having a pocket comprising a flange.

FIG. 5A illustrates a pocket 102 with a surrounding flange 103 creating a v shape with an arm and a leg forming an acute angle relative to the sole portion 104. In accordance with the illustrated embodiment, pocket 102 and flange 103 can be coupled to, and/or extend at least partially to, sole portion 104. While, in the illustrated embodiment, pocket 102 and flange 103 are shown on an outside of sole portion 104, pocket 102 and flange 103 can be coupled to an inside of sole portion 104 (e.g., within an outsole, between an outsole and a midsole, adjacent an insole, etc.).

Figure 5B:
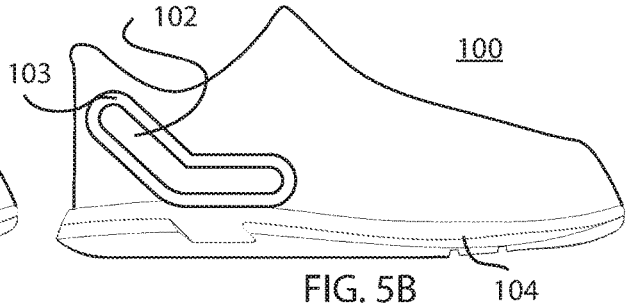

FIG. 5B illustrates a pocket 102 with a surrounding flange 103 creating a v shape with an arm and a leg forming an obtuse angle relative to the sole portion 104. In accordance with the illustrated embodiment, pocket 102 and flange 103 can be coupled to, and/or extend at least partially to, sole portion 104. While, in the illustrated embodiment, pocket 102 and flange 103 are shown on an outside of sole portion 104, pocket 102 and flange 103 can be coupled to an inside of sole portion 104 (e.g., within an outsole, between an outsole and a midsole, adjacent an insole, etc.).

Figure 5C:
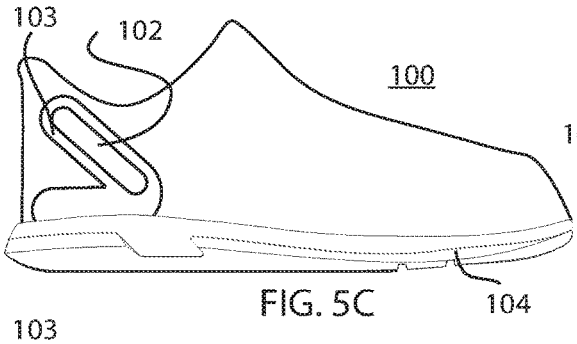

FIG. 5C illustrates a pocket 102 and a flange 103 together creating a v shape with an arm and a leg forming an acute angle relative to the sole portion 104. In such embodiment, the pocket 102 may not extend to the sole portion 104, while flange 103 may extend to the sole portion 104. In accordance with the illustrated embodiment, flange 103 can be coupled to, and/or extend at least partially to, sole portion 104. While, in the illustrated embodiment, flange 103 is shown on an inside of sole portion 104, flange 103 can be coupled to an outside of sole portion 104.

Figure 5D:
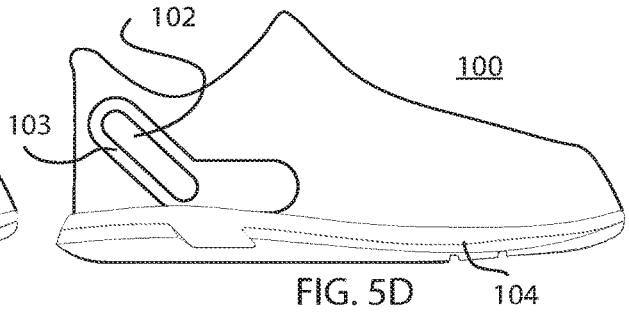

FIG. 5D illustrates a pocket 102 and a flange 103 together creating a v shape with an arm and a leg forming an obtuse angle relative to the sole portion 104. In such embodiment, the pocket 102 may not extend to the sole portion 104, while flange 103 may extend to the sole portion 104. In accordance with the illustrated embodiment, flange 103 can be coupled to, and/or extend at least partially to, sole portion 104. While, in the illustrated embodiment, flange 103 is shown on an inside of sole portion 104, flange 103 can be coupled to an outside of sole portion 104.

Figure 5E:
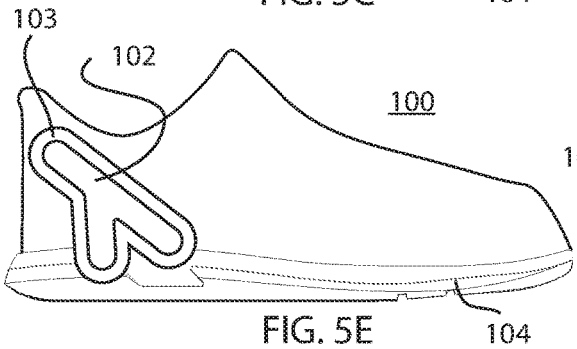

FIG. 5E illustrates a pocket 102 and a flange 103 together forming a y shape, wherein pocket 102 extends into the y branch created by flange 103. In accordance with the illustrated embodiment, pocket 102 and/or flange 103 can be coupled to, and/or extend at least partially to, sole portion 104. While, in the illustrated embodiment, pocket 102 and flange 103 are shown on an outside of sole portion 104, pocket 102 and flange 103 can be coupled to an inside of sole portion 104 (e.g., within an outsole, between an outsole and a midsole, adjacent an insole, etc.).

Figure 5F:
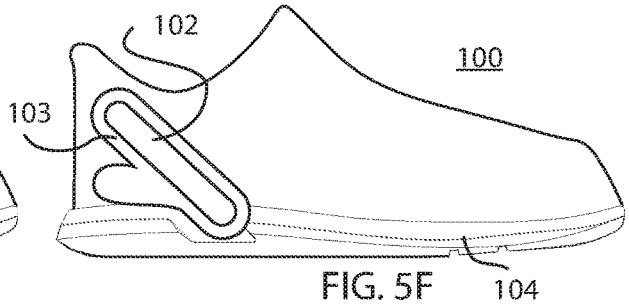

FIG. 5F illustrates a pocket 102 and a flange 103 together forming a y shape, wherein pocket 102 does not extend into the y branch created by flange 103. In accordance with the illustrated embodiment, pocket 102 and/or flange 103 can be coupled to, and/or extend at least partially to, sole portion 104. While, in the illustrated embodiment, pocket 102 and flange 103 are shown on an outside of sole portion 104, pocket 102 and flange 103 can be coupled to an inside of sole portion 104 (e.g., within an outsole, between an outsole and a midsole, adjacent an insole, etc.).

Figure 6A:
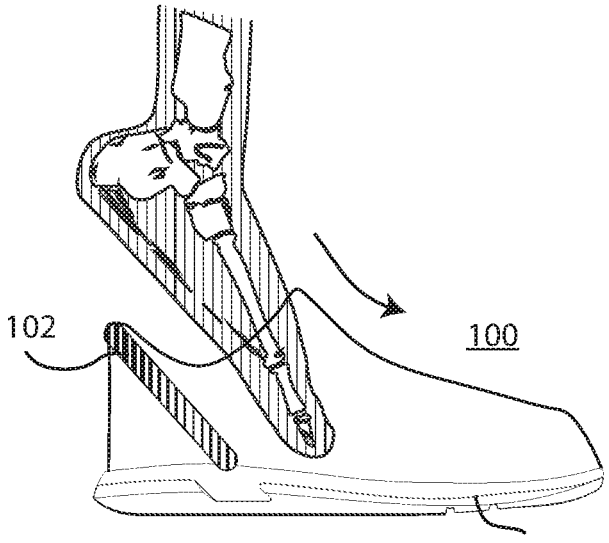
FIGS. 6A-6C progressively illustrate donning a rapid-entry shoe having uncollapsed and collapsed configurations, in accordance with the present disclosure.
Figure 6B:
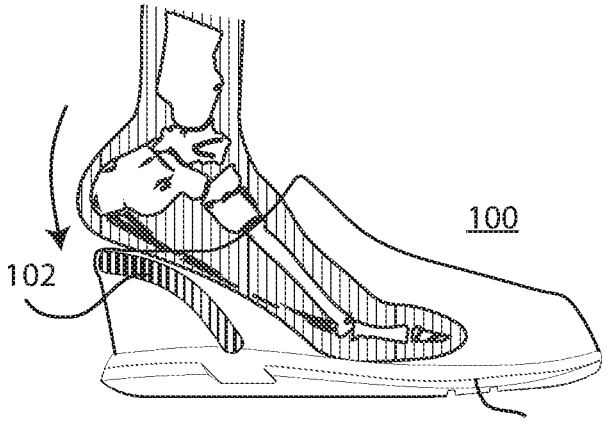
Figure 6C:
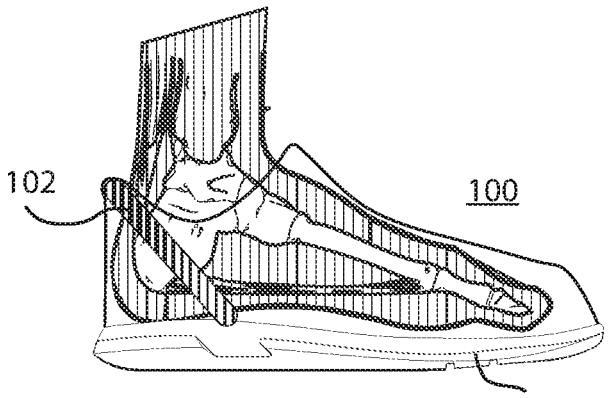

With reference now to FIGS. 6A-6C, a rapid-entry shoe 100, or a topline of a rear portion of a rapid-entry shoe 100, in accordance with the present disclosure, has a collapsed configuration (as illustrated in FIG. 6B) and an uncollapsed configuration (as illustrated in FIGS. 6A and 6C).

In a collapsed configuration (as illustrated in FIG. 6B), a rear portion of an upper of a rapid-entry shoe 100 is compressed toward a sole portion 104 of a rapid-entry shoe 100, and a pocket 102 integrated therein is compressed. Thus, in a collapsed configuration, a pocket 102 can compress out of the way of a heal to enlarge the opening of rapid-entry shoe 100 for easy entry/exit. In other words, in a collapsed configuration, a dimension of an opening of the shoe (e.g., a circumference following the topline of the opening, or a circumference around the topline of the opening measured in a single plane) may be greater than in an uncollapsed configuration, to facilitate easy entry/exit.

Thus, in an example embodiment, the rapid-entry shoe has a collapsed configuration in which an opening of the rapid-entry shoe is expanded to facilitate reception of a foot of an individual donning the rapid-entry shoe, and in the collapsed configuration, the pocket (e.g., an arm or other portion of the pocket) is compressed downward toward the sole portion of the rapid-entry shoe.

In an uncollapsed configuration (as illustrated in FIGS. 6A and 6C), a rear portion of an upper of a rapid-entry shoe 100 can be extended away from a sole portion 104 of a rapid-entry shoe 100, and a pocket 102 integrated therein is either not compressed or only partially compressed.

Thus, in an example embodiment, the rapid-entry shoe has an uncollapsed configuration in which the opening is unexpanded to retain a foot within the rapid-entry shoe, and in the uncollapsed configuration, the pocket (e.g., an arm or other portion of the pocket) is expanded away from the sole portion of the rapid-entry shoe.

In example embodiments, a rapid-entry shoe 100, or a topline of a rear portion of a rapid-entry shoe 100, can be biased toward an uncollapsed configuration by a pocket 102. Stated another way, in example embodiments, a rapid-entry shoe 100 at rest is in an uncollapsed configuration. In example embodiments, pressurization of the medium in the at least one pocket biases the topline and the rapid-entry shoe toward the uncollapsed configuration.

In example embodiments, a pocket 102 can create or otherwise enhance rebound of a rear portion of an upper of a rapid-entry shoe 100 toward an uncollapsed configuration, for example, at a topline of a rapid-entry shoe 100. Thus, a pocket 102 can lift a rear portion of an upper of a rapid-entry shoe 100 and thereby provide support and/or retention to a heel inserted into a rapid-entry shoe 100.

Figure 7A:
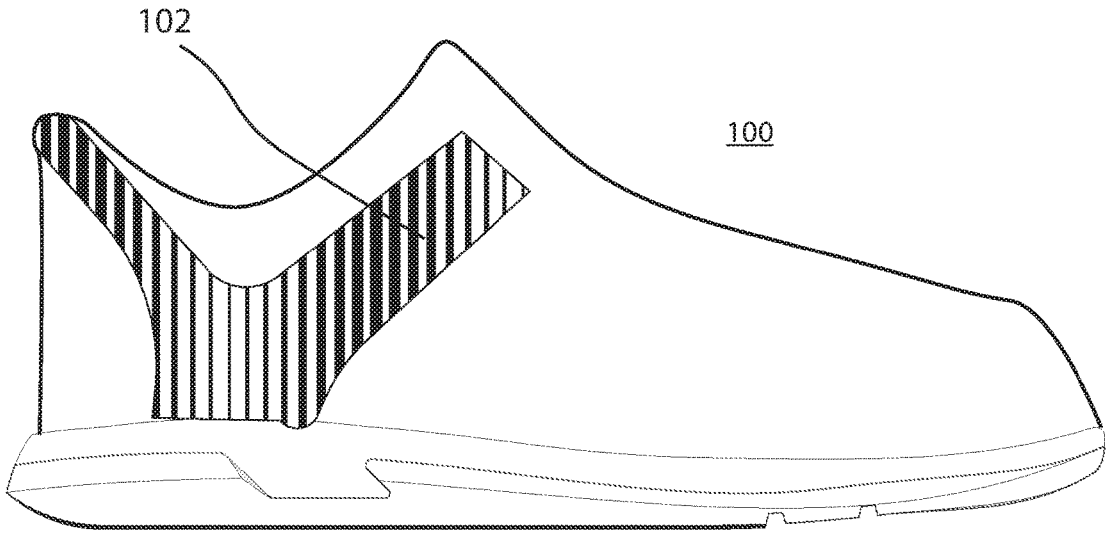
FIGS. 7A and 7B illustrate an example embodiment of a rapid-entry shoe having a pocket that extends across an upper portion.
Figure 7B:
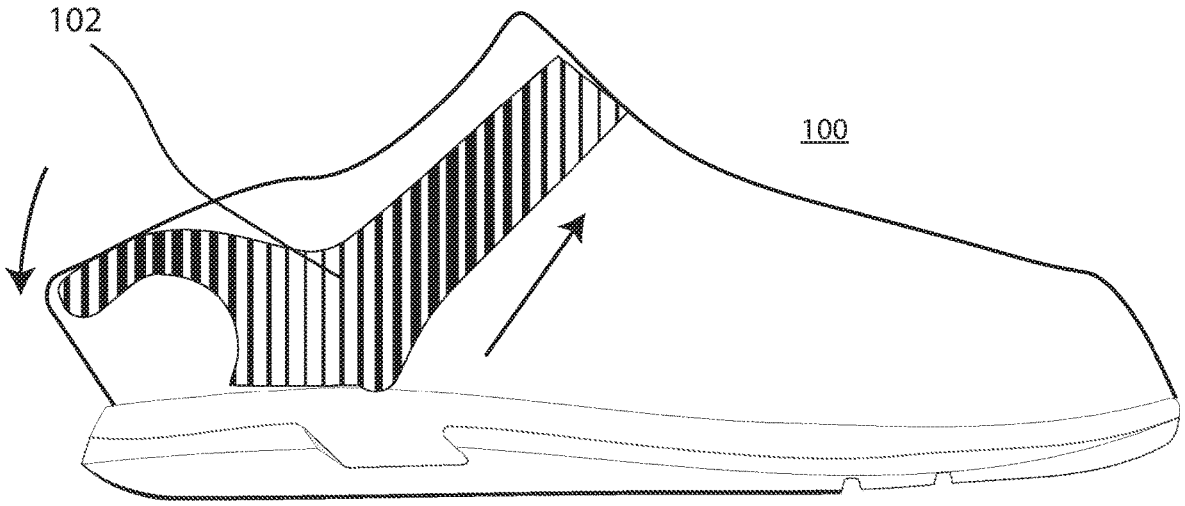

In other embodiments, and with reference to FIGS. 7A and 7B, a pocket 102 can extend from a side all or partially across a vamp, throat, tongue, nave or other upper portion of a rapid-entry shoe 100. In connection with the foregoing embodiment, a downward force exerted on a rear portion of a pocket 102 (during entry/exit) can expel a medium into an upper portion to enlarge the opening of rapid-entry shoe 100 for easy entry/exit.

Figure 8A:
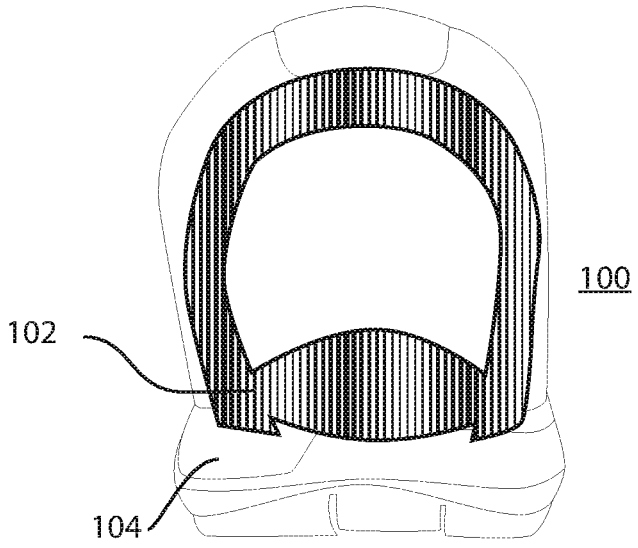
FIGS. 8A-8C illustrate views of an example embodiment of a rapid-entry shoe having a pocket that extends into a sole portion.
Figure 8B:
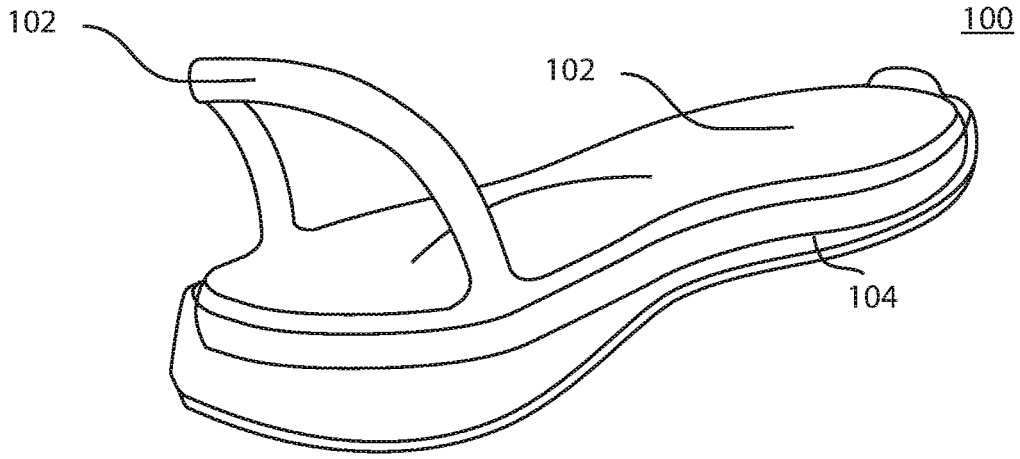
Figure 8C:
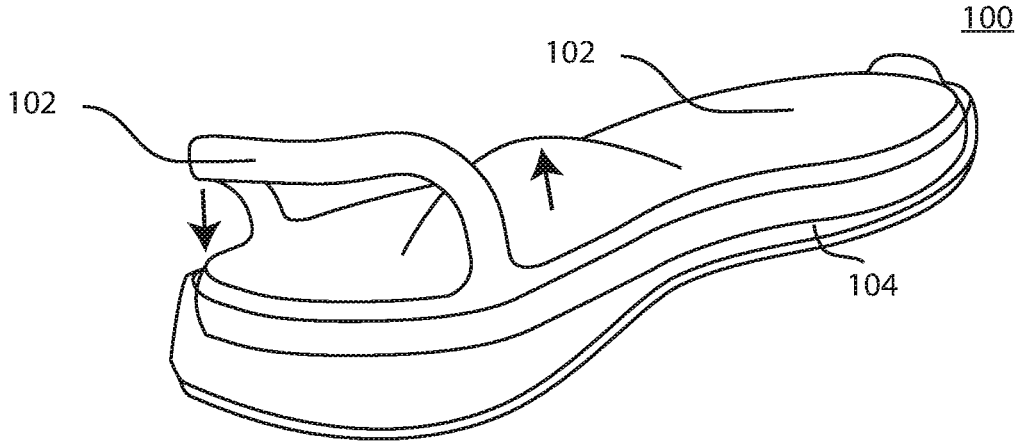

In still other embodiments, and with reference to FIGS. 8A-8C, a pocket 102 can extend from a side into a sole portion 104 of a rapid-entry shoe 100. In other embodiments, a pocket 102 extends from both sides into a sole portion 104 of a rapid-entry shoe 100. In this regard, a pocket 102 can extend under, and/or comprise, all or a portion of a footbed, insole, sock liner or the like of rapid-entry shoe 100.

In connection with the foregoing embodiments, a force exerted on a footbed, insole, sock liner or the like of rapid-entry shoe 100 (e.g., exerted by a foot's entry and/or stepping) can expel a medium from a sole portion into either or both sides of a rapid-entry shoe. Such expulsion of a medium can create or otherwise enhance rebound of a rear portion of an upper of a rapid-entry shoe, for example, at a topline of a rear portion of a rapid-entry shoe. Stated another way, such expulsion can facilitate an uncollapsed configuration.

Similarly, a reduced force on a footbed of a rapid-entry shoe (e.g., exerted by a foot's exit and/or not stepping) can expel a medium from either or both sides of a rapid-entry shoe into a sole portion. Such expulsion of a medium can relax a rear portion of an upper of a rapid-entry shoe, for example, at a topline of a rear portion of a rapid-entry shoe. Stated another way, such expulsion can facilitate a collapsed configuration.

In connection with any of the foregoing embodiments, a pocket 102 can comprise a damper to provide for gradual expulsion between an upper portion and a side (or both sides) of a rapid-entry shoe 100, or between a sole portion and a side (or both sides) of a rapid-entry shoe 100.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

I claim:

1. A rapid-entry shoe comprising:
a sole portion;
an upper coupled to the sole portion;
a pocket coupled to a side of the upper;
wherein the pocket comprises an arm and a leg, the leg of the pocket being substantially parallel to the sole portion, and the arm of the pocket being at an acute angle to the leg;
wherein the pocket encapsulates a medium;
wherein the medium is pressurized;
wherein the leg comprises a flange coupled to the sole portion;
wherein the pocket and the flange together comprise a v shape;
wherein the rapid-entry shoe has a collapsed configuration in which an opening of the rapid-entry shoe is expanded to facilitate reception of a foot of an individual donning the rapid-entry shoe;
wherein the rapid-entry shoe has an uncollapsed configuration in which the opening is unexpanded to retain the foot within the rapid-entry shoe;
wherein in the collapsed configuration, the arm of the pocket is compressed downward toward the sole portion of the rapid-entry shoe;
wherein in the uncollapsed configuration, the arm of the pocket is expanded away from the sole portion of the rapid-entry shoe; and
wherein the rapid-entry shoe is biased by the pressurized medium toward the uncollapsed configuration.

2. The rapid-entry shoe of claim 1, wherein the medium is a gas.

3. The rapid-entry shoe of claim 1, wherein the medium is a liquid.

4. The rapid-entry shoe of claim 1, wherein the arm comprises a plurality of serrations or scallops.

5. A rapid-entry shoe comprising:
a sole portion;
an upper coupled to the sole portion; and
a plurality of pockets, each of the plurality of pockets encapsulating a medium;
wherein each of the plurality of pockets is coupled to a rear portion of the upper;
wherein a first pocket of the plurality of pockets is located exclusively on a medial side of the shoe, and a second pocket of the plurality of pockets, the second pocket being separate and distinct from the first pocket, is located exclusively on a lateral side of the shoe;
wherein a topline of the rear portion has an uncollapsed configuration;
wherein the topline of the rear portion has a collapsed configuration in which a dimension of an opening of the shoe is greater than in the uncollapsed configuration; and
wherein the at least one pocket biases the topline toward the uncollapsed configuration.

6. The rapid-entry shoe of claim 5, wherein pressurization of the medium in each of the plurality of pockets biases the topline toward the uncollapsed configuration.

7. The rapid-entry shoe of claim 5, wherein each of the plurality of pockets extends into the sole portion.

8. The rapid-entry shoe of claim 5, wherein the medium is a gas.

9. The rapid-entry shoe of claim 5, wherein the medium is a liquid.

10. A rapid-entry shoe comprising:

a sole portion;

an upper coupled to the sole portion;

a pocket coupled to the upper;

wherein the pocket encapsulates a medium;

wherein the medium is pressurized;

wherein the rapid-entry shoe has a collapsed configuration in which an opening of the rapid-entry shoe is expanded to facilitate reception of a foot of an individual donning the rapid-entry shoe;

wherein the rapid-entry shoe has an uncollapsed configuration in which the opening is unexpanded to retain the foot within the rapid-entry shoe;

wherein in the collapsed configuration, an upper portion of the pocket is compressed downward toward the sole portion of the rapid-entry shoe;

wherein in the uncollapsed configuration, the upper portion of the pocket is expanded away from the sole portion of the rapid-entry shoe; and wherein the rapid-entry shoe is biased by the pressurized medium toward the uncollapsed configuration; and wherein a sole portion of the pocket extends under a footbed of the rapid-entry shoe into the sole portion such that a force exerted on the footbed expels the medium from the sole portion of the pocket into the upper portion of the pocket.

11. The rapid-entry shoe of claim 10, wherein the medium is a gas.

12. The rapid-entry shoe of claim 10, wherein the medium is a liquid.

13. The rapid-entry shoe of claim 10, wherein the pocket comprises a plurality of serrations or scallops.

* * * * *